US008517149B2

(12) United States Patent
Flynn et al.

(10) Patent No.: US 8,517,149 B2
(45) Date of Patent: Aug. 27, 2013

(54) METHOD OF HANDLING PASSENGER REQUESTS DURING ELEVATOR MODERNIZATION

(75) Inventors: Michael P. Flynn, Avon, CT (US); Allen Patenaude, Torrington, CT (US); Randall Greenberg, Oxford, CT (US); Paul H. Ouellette, Enfield, CT (US); Lee A. Hornfischer, Burlington, CT (US); Dennis Hanvey, Leonardo, NJ (US); Greg Barnes, Danville, CA (US); Vincent M. Maurino, Concord, CA (US); Max P. Prinsen, Renton, WA (US); Wade A. Montague, Southington, CT (US); Jannah A. Stanley, Portland, CT (US)

(73) Assignee: Otis Elevator Company, Farmington, CT (US)

( * ) Notice: Subject to any disclaimer, the term of this patent is extended or adjusted under 35 U.S.C. 154(b) by 384 days.

(21) Appl. No.: 13/058,869

(22) PCT Filed: Sep. 15, 2008

(86) PCT No.: PCT/US2008/076375

§ 371 (c)(1),
(2), (4) Date: Feb. 14, 2011

(87) PCT Pub. No.: WO2010/030290

PCT Pub. Date: Mar. 18, 2010

(65) Prior Publication Data

US 2011/0147134 A1 Jun. 23, 2011

(51) Int. Cl.
*B66B 1/28* (2006.01)

(52) U.S. Cl.
USPC ..... 187/247; 187/382; 187/391

(58) Field of Classification Search
USPC ..... 187/247, 248, 380–388, 391–396, 187/900
See application file for complete search history.

(56) References Cited

U.S. PATENT DOCUMENTS 4,844,204 A * 7/1989 Ovaska et al. ..... 187/247
5,352,857 A * 10/1994 Ovaska ..... 187/247

(Continued)

FOREIGN PATENT DOCUMENTS

EP 0631965 A1 1/1995
JP 2004051284 A 2/2004

(Continued)

OTHER PUBLICATIONS

International Preliminary Report on Patentability for International application No. PCT/US2008/076375 mailed Mar. 24, 2011.

(Continued)

*Primary Examiner* — Anthony Salata
(74) *Attorney, Agent, or Firm* — Carlson, Gaskey & Olds, P.C.

(57) ABSTRACT

An exemplary elevator system includes a first controller configured to recognize a hall call signal that indicates a passenger's desire to board an elevator car at a particular landing. The first controller is associated with at least one elevator car for assigning a hall call request to that elevator car. A second controller is configured to recognize a destination request that indicates a passenger's desire to be carried to a particular level. The destination request originates outside of an elevator car. The second controller is associated with at least one elevator car for assigning a destination request to that elevator car. The second controller is configured to determine whether a selected condition will be satisfied if a received destination request is serviced by an elevator car associated with the second controller. The second controller handles the received destination request in that manner if the condition will be satisfied. A cross dispatcher is configured to communicate with the second controller and to handle the destination request. If the condition will not be satisfied, the cross dispatcher provides an indication of a hall call signal corresponding to the received destination request to the first controller.

13 Claims, 3 Drawing Sheets

(56) References Cited

U.S. PATENT DOCUMENTS

| | | | | |
|---|---|---|---|---|
| 5,357,064 | A * | 10/1994 | Boyce et al. | 187/247 |
| 5,389,748 | A * | 2/1995 | Burke et al. | 187/247 |
| 6,062,343 | A * | 5/2000 | Wang | 187/247 |
| 6,427,807 | B1 * | 8/2002 | Henneau | 187/247 |
| 6,892,861 | B2 * | 5/2005 | Friedli | 187/247 |
| 6,935,465 | B2 | 8/2005 | Friedli | |
| 7,900,750 | B2 * | 3/2011 | Mattsson et al. | 187/247 |
| 7,918,318 | B2 * | 4/2011 | Friedli et al. | 187/247 |
| 8,172,043 | B2 * | 5/2012 | Hughes et al. | 187/382 |
| 2003/0116384 | A1 | 6/2003 | Friedli | |
| 2008/0023271 | A1 | 1/2008 | Kocher et al. | |
| 2008/0149432 | A1 | 6/2008 | Friedli et al. | |
| 2011/0120813 | A1 * | 5/2011 | Flynn et al. | 187/384 |

FOREIGN PATENT DOCUMENTS

| | | | |
|---|---|---|---|
| WO | 2007011346 | A2 | 1/2007 |
| WO | 2008051217 | A1 | 5/2008 |

OTHER PUBLICATIONS

International Search Report and Written Opinion of the International Searching Authority for International application No. PCT/US2008/076375 mailed Jun. 5, 2009.

* cited by examiner

METHOD OF HANDLING PASSENGER REQUESTS DURING ELEVATOR MODERNIZATION

BACKGROUND

Elevator systems traditionally facilitate passenger requests made by activating a hall call fixture. For example, a passenger at a particular floor can press an up or down button to indicate a desire to be carried to a different level within a building. An elevator controller recognizes the hall call placed in such a manner and assigns an elevator car to arrive at the corresponding landing to pick up the passenger. Upon entering the elevator car, the passenger uses a car operating panel to provide an indication of the floor to which the passenger desires to be carried.

It is also known to control an elevator system based upon destination entry requests from passengers. A difference between a destination entry request and a hall call is that the passenger provides an indication of their desired destination prior to entering the elevator car. There are various known destination entry systems and associated control techniques.

In some cases it is desirable to modernize or upgrade an existing elevator system that operates based upon passenger requests made at hall call fixtures so that the elevator system can operate based upon destination entry requests. To modernize or update such an elevator system, destination entry devices and appropriate controllers must be installed at appropriate locations within a building. It is desirable to minimize the amount of inconvenience to elevator passengers and building owners during a modernization process. To accomplish that goal, it is necessary to have a strategy for handling different types of passenger requests for service in the event that hall call fixtures and destination entry devices are both operational in association with the same elevator system.

SUMMARY

An exemplary elevator system includes a first controller configured to recognize a hall call signal that indicates a passenger's desire to board an elevator car at a particular landing. The first controller is associated with at least one elevator car for assigning a hall call request to that elevator car. A second controller is configured to recognize a destination request that indicates a passenger's desire to be carried to a particular level. The destination request originates outside of an elevator car. The second controller is associated with at least one elevator car for assigning a destination request to that elevator car. The second controller is configured to determine whether a selected condition will be satisfied if a received destination request is serviced by an elevator car associated with the second controller. The second controller handles the received destination request in that manner if the condition will be satisfied. A cross dispatcher is configured to communicate with the second controller and to handle the destination request. If the condition will not be satisfied, the cross dispatcher provides an indication of a hall call signal corresponding to the received destination request to the first controller.

An exemplary method of controlling elevator car assignments is useful in an elevator system having a first controller and a second controller. The first controller is configured to recognize a hall call signal that indicates a passenger's desired to board an elevator car at a particular landing and to assign a hall call request to an elevator car. The second controller is configured to recognize a destination request that indicates a passenger's desire to be carried to a particular level and to assign the destination request to an elevator car. The destination request originates outside of an elevator car. The method includes determining whether a selected condition will be satisfied if a received destination request is serviced by an elevator car associated with the second controller. The destination request is handled by the second controller if the selected condition will be satisfied. Otherwise, an indication of a hall call signal corresponding to the received destination request is provided to the first controller.

The various features and advantages of the disclosed examples will become apparent to those skilled in the art from the following detailed description.

The drawings that accompany the detailed description can be briefly described as follows.

DETAILED DESCRIPTION

Figure 1:
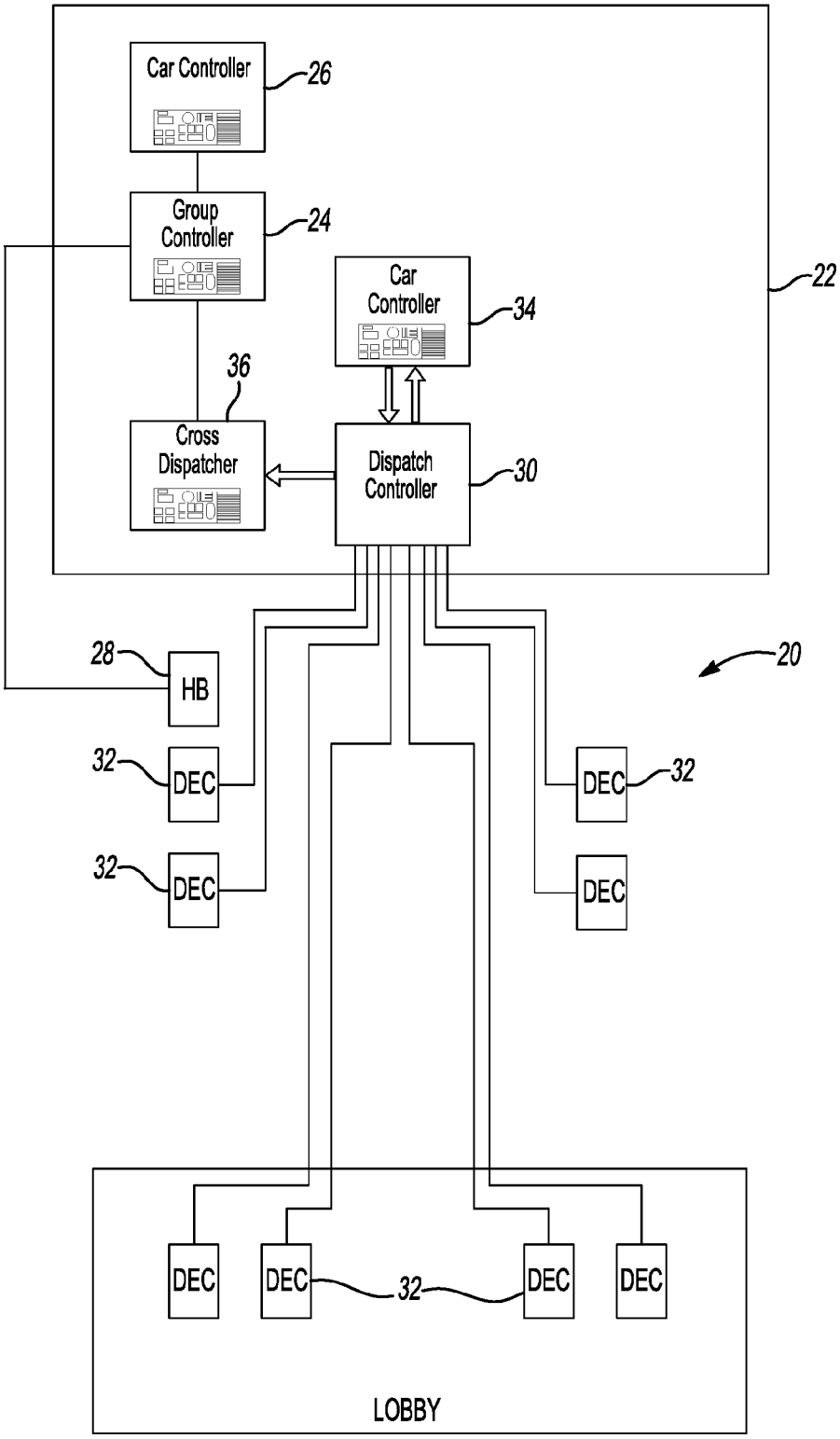
FIG. 1 schematically illustrates selected portions of an elevator system.

FIG. 1 schematically shows selected portions of an elevator system 20. A control arrangement 22 is useful for responding to passenger requests for elevator service and to assign elevator cars to such requests. In this example, the elevator system 20 is undergoing a modernization or update operation so that the elevator system, which has been capable of responding to traditional hall call requests from passengers, will be able to respond to destination entry requests from passengers.

The example of FIG. 1 includes a group controller 24 and an example car controller 26 that each operate in a generally known manner for assigning an elevator car to respond to a hall call request made by a passenger. The example of FIG. 1 includes at least one hall call fixture (HB) 28 with which a passenger can place a hall call request. For example, the hall call fixture (HB) 28 may have an up button and a down button for an individual to provide an indication of a direction in which that individual wishes to be carried from a particular level of a building. The group controller 24 and the car controller 26 cooperate in a known manner to respond to that request.

The example of FIG. 1 also includes equipment for modernizing or updating the elevator system 20. A destination entry dispatch controller 30 receives and recognizes destination entry requests from passengers made at destination entry devices 32 (DEC). A destination entry request, as that term is used in this document, refers to a passenger request for service that includes an indication of the passenger's desired destination made outside of an elevator car. The destination entry devices 32 allow a passenger to indicate their desired destination floor before the passenger enters an elevator car. The dispatch controller 30 provides a car assignment to an elevator car by communicating with a car controller 34 that responds to the destination request using a known technique.

In the example of FIG. 1, it is possible for a passenger to use one of the destination entry devices 32. It is also possible for a passenger to use a hall call fixture 28. In either case, the elevator system 20 should respond to the passenger's request and provide elevator service as conveniently as possible for the passenger. The example of FIG. 1 includes a cross dispatcher 36 that allows for a passenger request placed at one of the destination entry devices 32 to be handled by an elevator car controlled by the group controller 24 even though such an elevator car does not have a controller 34 communicating with the dispatch controller 30. In this example, the dispatch controller 30 receives a passenger destination request. The dispatch controller 30 makes a determination whether a selected condition will be satisfied for purposes of determining whether the request should be handled by a modernized elevator car having a controller 34 associated with the dispatch controller 30 or if it should be handled by one of the elevator cars that has not yet been modernized such as one controlled by the group controller 24.

Figure 2:
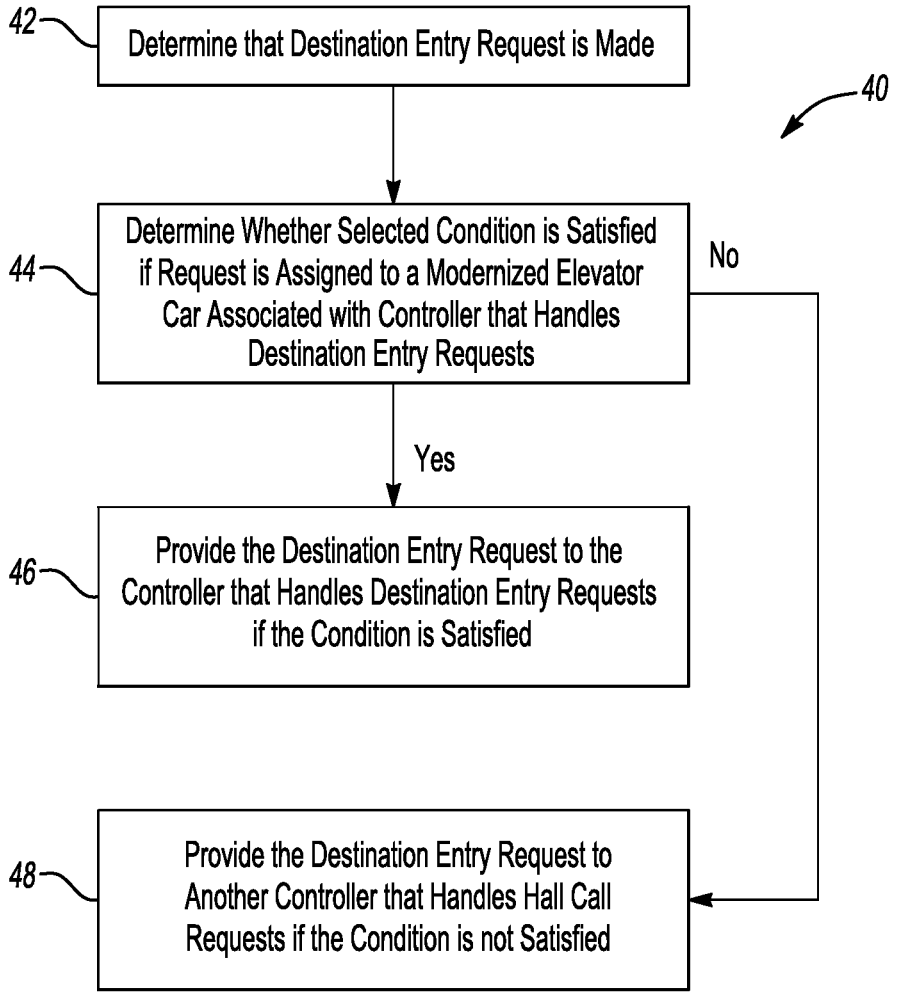
FIG. 2 is a flowchart diagram summarizing one example approach.

FIG. 2 includes a flowchart diagram 40 summarizing one example approach. At 42, a determination is made that a destination entry request was placed by a passenger. At 44, a determination is made whether a selected condition will be satisfied if the request is assigned to a modernized elevator car associated with the dispatch controller 30. If so, the destination entry request is provided to the car controller 34 of a modernized car at 46. If the condition will not be satisfied, the destination entry request is provided to another controller that handles hall call requests.

In the example of FIG. 1, when the selected condition will not be satisfied, the dispatch controller 30 communicates with a cross dispatcher 36 regarding the destination entry request. The cross dispatcher 36 provides an indication to the group controller 24 regarding a hall call request corresponding to the destination entry request. For example, the cross dispatcher 36 provides an indication of the level at which the destination entry request was placed and an indication of the direction of travel desired by the passenger to the controller 24 so that the controller 24 recognizes the information as if it were a hall call request placed using a hall call fixture 28. The controller 24 can then respond to the request by assigning an appropriate elevator car and a corresponding controller 26 controls the car to respond to such a request.

In one example, the selected condition includes having one of the modernized elevator cars service the request within a selected amount of time. If such service is possible, the destination request will be handled by one of the cars having a controller 34 that responds directly to the dispatch controller 30. If the modernized elevator cars are too busy, however, and it will not be possible to provide passenger service within such a time (e.g., the passenger wait time for the elevator car to arrive to pick up the passenger will be too long), the dispatch controller 30 communicates with the cross dispatcher 36 so that the passenger request will be handled by an elevator car that responds to hall calls.

In some examples, the cross dispatcher 36 includes appropriate hardware, software or both for translating between a destination entry request and a corresponding hall call indication. In another example, the dispatch controller 30 includes hardware, software or both for translating between a destination entry request and a corresponding hall call indication to provide that to the cross dispatcher 36. In other examples, the process of converting a destination entry request to a hall call indication is partially accomplished within the dispatch controller 30 and partially accomplished within the cross dispatcher 36.

When the dispatch controller 30 determines that the condition can be satisfied by assigning the destination entry request to one of the modernized elevator cars controlled by the controller 34, the dispatch controller 30 communicates with the corresponding destination entry device 32 to provide an indication to the passenger which elevator car will provide the desired service. Once the passenger enters that elevator car, no further interaction is required as the system already knows the destination to which the passenger desires to be carried.

If the selected condition is not satisfied and a destination entry request is converted to a hall call indication, the dispatch controller 30 communicates with the corresponding destination entry device 32 to provide an indication to the passenger regarding which car will arrive to service the request. An indication is also provided to the passenger telling the passenger that a destination indication must be made upon entering the elevator car (e.g., by pressing an appropriate button on a car operating panel as is done with traditional elevator systems). That way, the passenger will recognize that although they used a destination entry device to place the request for service, the passenger has to do something more than is normally required when using a destination entry device to achieve the desired service. In the event that there are other indicators in the lobby or near the landing of the corresponding elevator car, the controller 24 or the dispatch controller 30 will cause appropriate lanterns to light or audible sounds to be given to direct the passenger to an appropriate car.

With such an arrangement, elevator cars that have not been updated may serve any floors that have active hall call fixtures 28 or destination entry fixtures 32. Modernized elevator cars that are now configured to respond to destination entry requests are not capable of servicing floors that have hall call buttons because a passenger is not able to enter a desired destination upon entering such an elevator car.

As schematically shown in FIG. 1, a passenger request placed at a hall call fixture (e.g., a hall call request) is communicated directly to the existing group controller 24 as occurred before the modernization procedure began.

Figure 3:
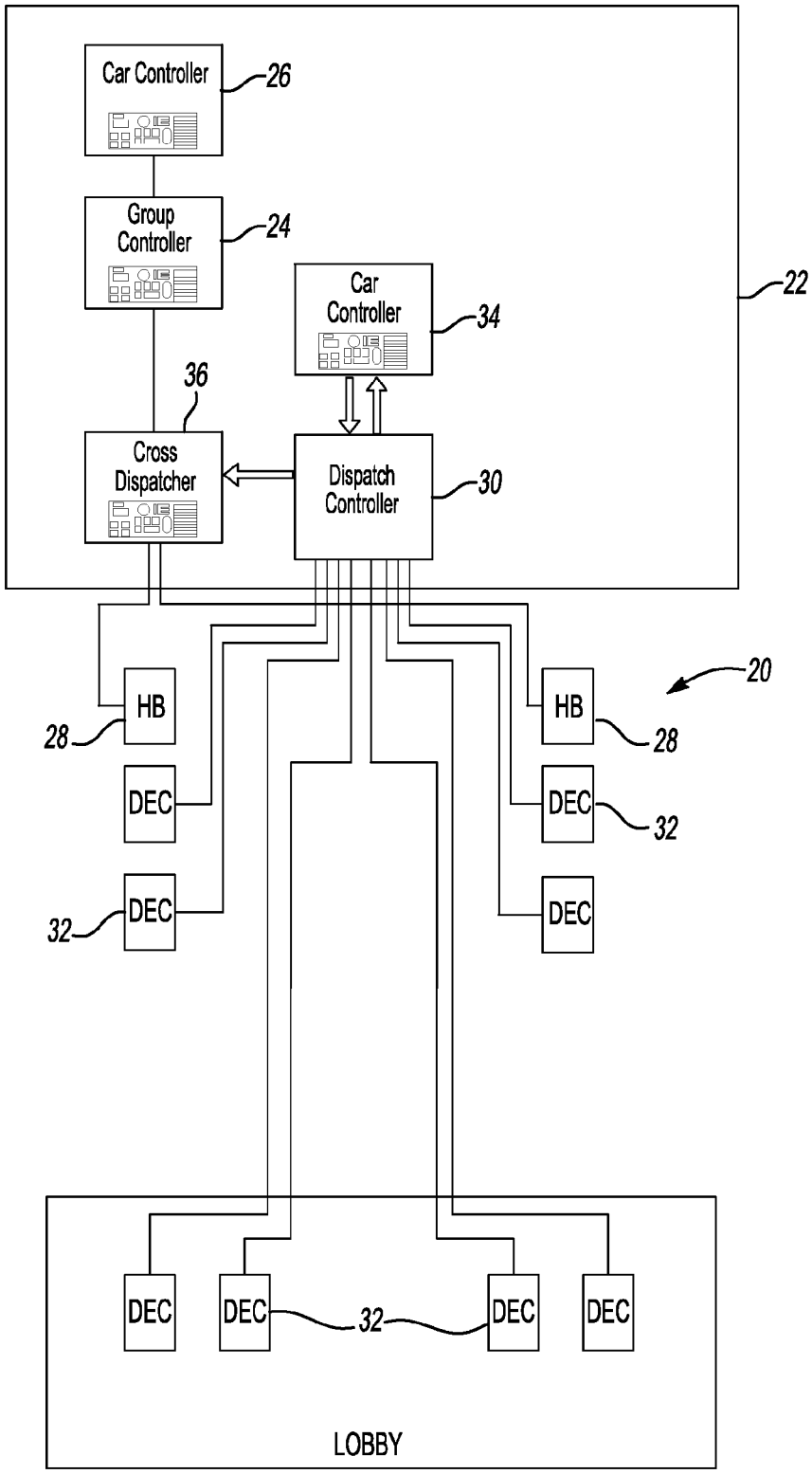
FIG. 3 schematically illustrates selected portions of another example elevator system.

FIG. 3 shows another example arrangement that operates in the same manner as the example described above. An additional feature in the example of FIG. 3 is that hall call requests placed at the hall call fixtures 28 are provided to the cross dispatcher 36. The cross dispatcher recognizes a hall call request as such and forwards it on the existing group controller 24. The cross dispatcher 36 in this example also retains information regarding the number of hall call requests within a given time. This information is useful to the dispatch controller 30 for determining whether a passenger request should be provided to one of the traditional elevator cars controlled by the group controller 24 if the selected condition will not be met by assigning the request to one of the modernized elevator cars controlled by the dispatch controller 30. Information regarding how busy the traditional elevator cars are at a particular time allows the dispatch controller 30 in this example to still assign a destination entry request to a modernized elevator car even if the initial selected condition is not satisfied based upon a determination that the other (i.e., not yet modernized) elevator cars are so busy that better service will be provided by keeping the destination entry request for purposes of assigning it to an elevator car that is capable of responding to such a request directly (i.e., not converting it to a hall call indication and providing it to an elevator car that is only capable of responding to hall calls).

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

at least one hall call fixture that is useable by a passenger to place a hall call;

a first controller that communicates directly with the hall call fixture to directly receive a hall call signal that indicates a passenger's desire to board an elevator car at a particular landing, the first controller is associated with at least one elevator car for assigning a hall call request to the at least one elevator car;

at least one destination entry device that is useable by a passenger to enter a destination request;

a second controller that communicates directly with the destination entry device to directly receive a destination request that indicates a passenger's desire to be carried to a particular level, the destination request originating outside of an elevator car, the second controller is associated with at least one elevator car for assigning a destination request to the at least one elevator car, the second controller is configured to determine whether a selected condition will be satisfied if a received destination request is serviced by an elevator car associated with the second controller and to handle the received destination request if the condition will be satisfied; and a cross dispatcher that is configured to communicate with the second controller to receive an indication of the destination request from the second controller if the condition will not be satisfied and to handle the destination request by providing an indication of a hall call signal corresponding to the received destination request to the first controller.

2. The system of claim 1, wherein the destination entry device comprises an interface for communicating information to the passenger and wherein the interface provides an indication of an assigned elevator car that will service the destination request.

3. The system of claim 2, wherein the interface provides an indication that the passenger will have to enter the desired destination level upon entering the assigned elevator car when the assigned elevator car is associated with the first controller.

4. The system of claim 1, wherein the second controller uses information regarding hail calls assigned to the at least one elevator car associated with the first controller when determining whether to provide the received destination request to the cross dispatcher.

5. The system of claim 4, wherein the first controller provides an indication of hall calls assigned to the at least one elevator car associated with the first controller to the cross dispatcher.

6. The system of claim 1, wherein the selected condition comprises the destination request being serviced within a specified time.

7. The system of claim 6, wherein the specified time comprises an amount of time that the passenger will wait for an elevator car to arrive to receive the passenger.

8. A method of controlling elevator car assignments in an elevator system having a first controller configured to recognize a hall call signal from a hall call fixture that indicates a passenger's desire to board an elevator car at a particular landing and to assign a hall call request to an elevator car and a second controller configured to recognize a destination request from a destination entry device that indicates a passenger's desire to be carried to a particular level and to assign the destination request to an elevator car, the destination request originating outside of an elevator car, the method comprising the steps of:

communicating any hall call signal from the hall call fixture directly to the first controller;

communicating any destination request from the destination entry device directly to the second controller;

using the second controller for determining whether a selected condition will be satisfied if a received destination request is serviced by an elevator car associated with the second controller;

handling the received destination request by the second controller if the selected condition will be satisfied, and otherwise communicating an indication of the destination request to a cross dispatcher and providing an indication of a hall call signal corresponding to the received destination request from the cross dispatcher to the first controller if the selected condition will not be satisfied.

9. The method of claim 8, comprising providing an indication of an assigned elevator car that will service the destination request to the passenger.

10. The method of claim 9, comprising providing an indication that the passenger will have to enter the desired destination level upon entering the assigned elevator car when the assigned elevator car is associated with the first controller.

11. The method of claim 1, comprising using information regarding hall calls assigned to any elevator cars associated with the first controller when determining whether to provide the received destination request to the cross dispatcher.

12. The method of claim 8, wherein the selected condition comprises the destination request being serviced within a specified time.

13. The method of claim 12, wherein the specified time comprises an amount of time that the passenger will wait for an elevator car to arrive to receive the passenger.

* * * * *